US008939118B2

(12) United States Patent
Stoody

(10) Patent No.: US 8,939,118 B2
(45) Date of Patent: Jan. 27, 2015

(54) ROCKER ARM PROVIDING CYLINDER DEACTIVATION

(75) Inventor: Ira R. Stoody, Roseville, MI (US)

(73) Assignee: Chrysler Group LLC, Auburn Hills, MI (US)

( * ) Notice: Subject to any disclaimer, the term of this patent is extended or adjusted under 35 U.S.C. 154(b) by 339 days.

(21) Appl. No.: 13/316,018

(22) Filed: Dec. 9, 2011

(65) Prior Publication Data

US 2013/0146008 A1 Jun. 13, 2013

(51) Int. Cl.
*F01L 1/18* (2006.01)
*F01L 1/26* (2006.01)
*F01L 13/00* (2006.01)

(52) U.S. Cl.
CPC ..... *F01L 1/267* (2013.01); *F01L 13/0036* (2013.01); *F01L 13/0005* (2013.01); *F01L 2105/00* (2013.01); *F01L 2105/02* (2013.01)
USPC ..... 123/90.39

(58) Field of Classification Search
CPC ... F01L 1/267; F01L 13/0005; F01L 13/0036; F01L 2105/02; F01L 2105/00
USPC ..... 123/90.15, 90.16, 90.39, 90.4, 90.41, 123/90.42, 90.43, 90.44, 90.45, 90.47, 123/90.12, 90.13
See application file for complete search history.

(56) References Cited

U.S. PATENT DOCUMENTS 4,887,563 A * 12/1989 Ishida et al. ..... 123/90.16
5,031,583 A * 7/1991 Konno ..... 123/90.16
5,042,437 A * 8/1991 Sakuragi et al. ..... 123/90.16
5,544,626 A * 8/1996 Diggs et al. ..... 123/90.16
5,553,584 A * 9/1996 Konno ..... 123/90.16
6,412,460 B1 * 7/2002 Sato et al. ..... 123/90.16
6,467,444 B2 * 10/2002 Tanaka et al. ..... 123/90.16
6,769,387 B2 * 8/2004 Hayman et al. ..... 123/90.39
6,923,151 B2 * 8/2005 Kreuter ..... 123/90.16
7,089,899 B1 * 8/2006 Genise et al. ..... 123/90.39
7,263,956 B2 9/2007 Spath et al.
7,377,241 B2 * 5/2008 Hirano ..... 123/90.16
7,673,601 B2 3/2010 Spath et al.
8,505,509 B2 * 8/2013 Ha et al. ..... 123/90.39
2003/0075129 A1 4/2003 Spath et al.
2005/0247279 A1 * 11/2005 Rorig et al. ..... 123/90.16

(Continued)

FOREIGN PATENT DOCUMENTS

DE 10316189 A1 10/2004

OTHER PUBLICATIONS

International Search Report dated Feb. 11, 2013 for International Application No. PCT/US2012/066985, International Filing Date Nov. 29, 2012.

(Continued)

*Primary Examiner* — Kenneth Bomberg
*Assistant Examiner* — Jason T Newton
(74) *Attorney, Agent, or Firm* — Ralph E Smith

(57) ABSTRACT

A rocker arm assembly to provide either cylinder deactivation or reduced valve lift. The rocker arm assembly includes inner and outer portions that are rotatably connected to one another. In one state, the inner and outer portions are locked together to provide traditional valve lift. In a second state, the inner portion is allowed to rotate relative to the outer portion to deactivate the cylinder or provide reduced valve lift. Bearings on both the inner and outer portions provide rolling contact with corresponding cam shaft features. A hydraulic system provides transition between the first and second states.

10 Claims, 6 Drawing Sheets

(56) References Cited

U.S. PATENT DOCUMENTS

| | | | | |
|---|---|---|---|---|
| 2007/0084426 | A1* | 4/2007 | Seitz | 123/90.39 |
| 2007/0113813 | A1 | 5/2007 | Lalone | |
| 2007/0295293 | A1 | 12/2007 | Spath et al. | |
| 2008/0141964 | A1* | 6/2008 | Ha et al. | 123/90.39 |
| 2012/0048223 | A1* | 3/2012 | Ha et al. | 123/90.16 |

OTHER PUBLICATIONS

Written Opinion dated Feb. 11, 2013 for International Application No. PCT/US2012/066985, International Filing Date Nov. 29, 2012.

Delphi 2-Step Valve Lift System—Powertrain Systems, pp. 1-2, www.delphi.com.

* cited by examiner

ROCKER ARM PROVIDING CYLINDER DEACTIVATION

FIELD

The present disclosure relates to a rocker arm for an internal combustion engine and, more particularly, to a type two rocker arm that facilitates cylinder deactivation or two-step valve lift.

BACKGROUND

Cylinder deactivation and variable valve lift techniques are used to vary the power characteristics of internal combustion engines. Engines with cylinder deactivation capabilities are fuel efficient while still providing additional power when necessary. Improved fuel economy is achieved by deactivating a number of cylinders when the engine is under lower loads, effectively decreasing the displacement of the engine during these times. For example, four cylinders of an eight cylinder engine can be deactivated to halve the engine displacement and realize the improved fuel economy of a smaller displacement four cylinder engine. When larger loads are present, such as during periods of acceleration or traveling up hill, all eight cylinders are used to provide ample power until the higher load conditions subside.

Rather than entirely deactivating cylinders, variable valve lift systems allow the power characteristics of an engine to be changed during driving while continuing to utilize all of the cylinders. These systems can also provide improved fuel economy and may be used to provide other benefits in situations where it would be beneficial to dynamically change engine power characteristics. It would be beneficial to improve current cylinder deactivation and variable valve lift techniques.

SUMMARY

The present disclosure provides a new rocker arm which facilitates either cylinder deactivation or two-step valve actuation.

In one form, the present disclosure provides a rocker arm apparatus comprising at least one inner arm portion and at least one outer arm portion. The at least one inner arm portion is pivotally connected to the at least one outer arm portion by a shaft located near a valve end of the rocker arm such that the at least one inner arm portion can rotate relative to the at least one outer arm portion.

In another form, the present disclosure provides a rocker arm apparatus comprising at least one generally U-shaped outer arm portion including a first outer arm segment and a second outer arm segment. The rocker arm apparatus further comprises at least one inner arm portion pivotally attached to the first and second outer arm segments near a valve end of the rocker arm apparatus, the at least one inner arm portion positioned between the first and second outer arm segments. Additionally the rocker arm apparatus comprises a first bearing attached to the at least one inner arm portion to provide rolling contact with a lobe of a cam shaft, a second bearing attached to the first outer arm segment, a third bearing attached to the second outer arm segment, and a lost motion spring positioned between the at least one inner arm portion and the at least one outer arm portion near a hydraulic lash adjuster end of the rocker arm apparatus. The lost motion spring resists rotation of the at least one inner arm portion relative to the at least one outer arm portion.

Further areas of applicability of the present disclosure will become apparent from the detailed description and claims provided hereinafter. It should be understood that the detailed description, including disclosed embodiments and drawings, are merely exemplary in nature intended for purposes of illustration only and are not intended to limit the scope of the invention, its application or use. Thus, variations that do not depart from the gist of the invention are intended to be within the scope of the invention.

DETAILED DESCRIPTION

Figure 1:
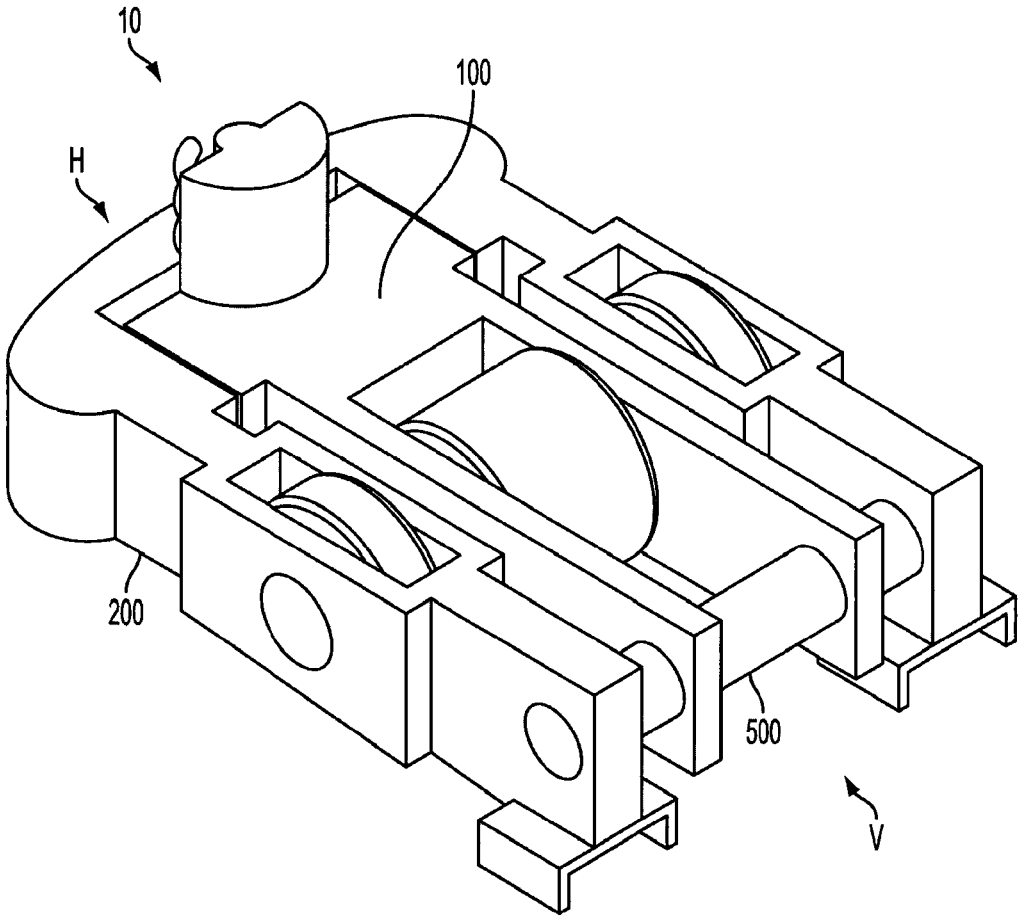
FIG. 1 is a front perspective view of a rocker arm assembly in accordance with the present disclosure.
Figure 2:
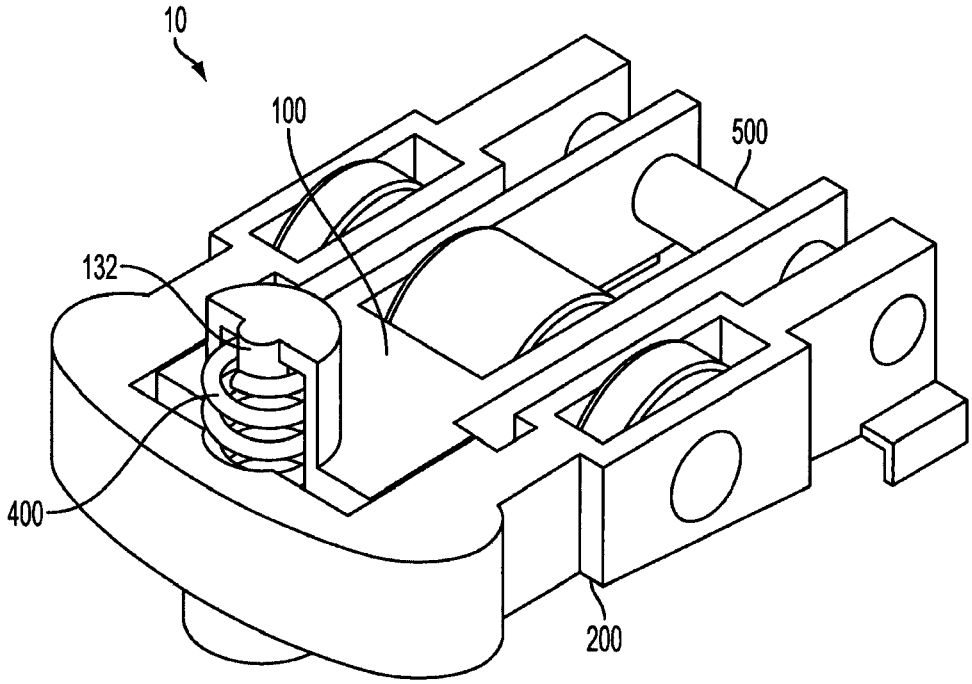
FIG. 2 is a rear perspective view of a rocker arm assembly in accordance with the present disclosure.

The present disclosure provides a new rocker arm, which provides either cylinder deactivation or two-step valve actuation. The disclosed rocker arm actuates two valves simultaneously and uses rollers in contact with the cam rather than sliding surfaces. Additionally, the disclosed rocker arm utilizes a hydraulic system to activate and deactivate valves in a cylinder deactivation system or to switch between valve actuation profiles in a variable valve lift system.

Referring now to the drawings, FIGS. 1-6 illustrate an embodiment of a rocker arm assembly 10 according to the present disclosure. The rocker arm assembly 10 includes inner arm portion 100 and outer arm portion 200. The inner arm portion 100 and outer arm portion 200 are pivotally connected to one another at a valve end V by shaft 500. Outer arm portion 200 is generally U-shaped containing a first outer arm segment 210 and a second outer arm segment 220. First and second outer arm segments 210, 220 are connected to one another at a hydraulic lash adjuster (HLA) end H of the rocker arm assembly 10. Inner arm portion 100 is located within outer arm portion 200 between first outer arm segment 210 and second outer arm segment 220. A lost motion spring 400 is positioned between inner arm portion 100 and outer arm portion 200 at the HLA end of the rocker arm assembly 10.

Figure 3:
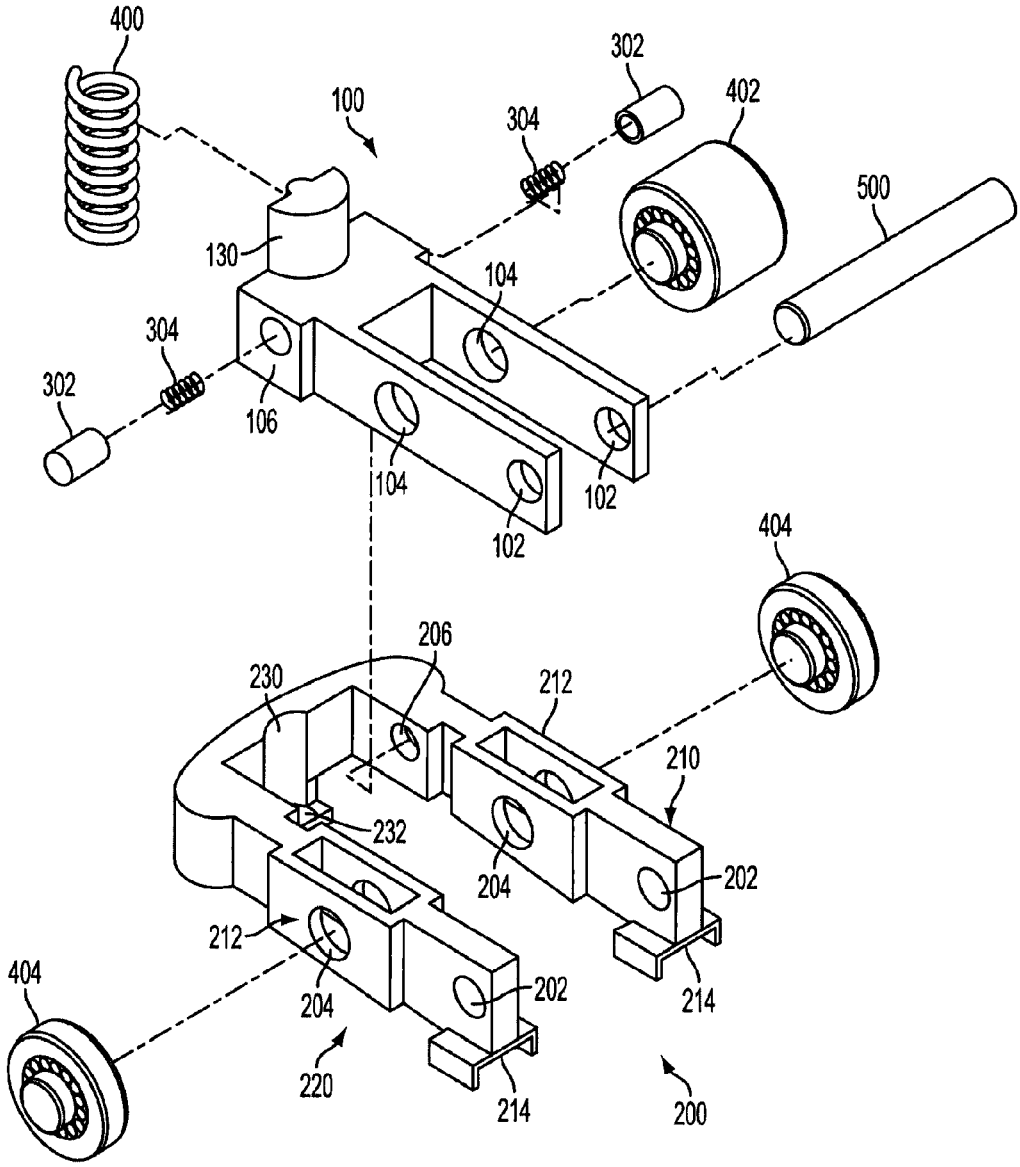
FIG. 3 is an exploded view of a rocker arm assembly in accordance with the present disclosure.

As seen in FIG. 3, inner arm portion 100 includes two holes 102 at the valve end through which shaft 500 is positioned to pivotally connect inner arm portion 100 to outer arm portion 200. Inner arm portion contains two additional holes 104 in which inner arm bearing 402 is mounted. Inner arm portion 100 further contains two blind holes 106 located near the HLA end, which serve as part of the hydraulic latch-up system discussed in more detail below. At the HLA end, inner arm portion 100 includes an inner arm spring engagement element 130. Inner arm spring engagement element 130 is formed generally as a partial cylindrical shell with a central cylindrical pin 132 (seen in FIG. 2) extending down from a top portion to engage lost motion spring 400.

Outer arm section 200 includes two holes 202 in which shaft 500 is situated, pivotally connecting outer arm section 200 to inner arm section 100. Outer arm section 200 also includes two bearing mounting sections 212, each containing holes 204 in which outer arm bearings 404 are mounted. Outer arm section 200 further includes blind holes 206 near the HLA end. Holes 206 are positioned such that when inner arm section 100 is rotated relative to outer arm section 200 holes 206 can be aligned with holes 106.

Figure 6:
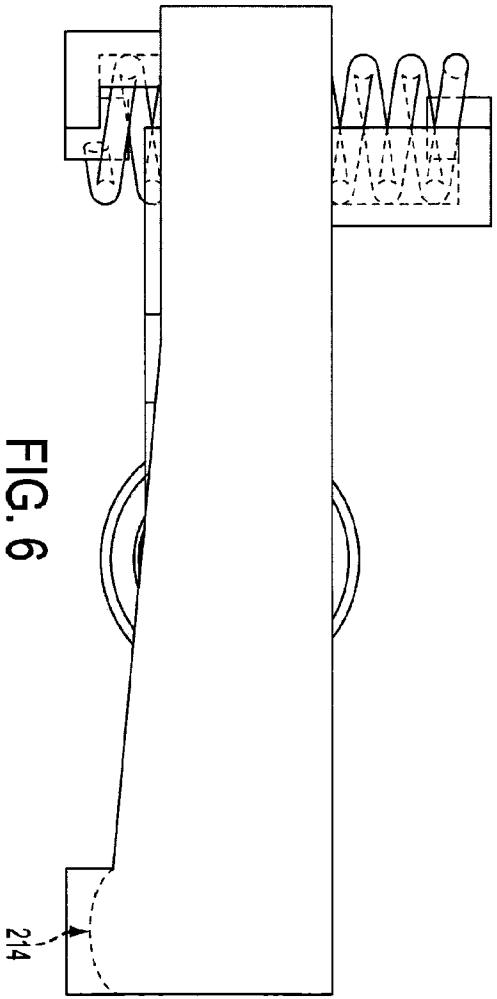
FIG. 6 is a side view of a rocker arm assembly in accordance with the present disclosure.

Outer arm section 200 also includes outer arm spring engagement element 230 at the HLA end. Outer arm spring engagement element 230 includes a central cylindrical pin 232 extending upward from a bottom portion to engage lost motion spring 400. Outer arm section 200 also includes two valve abutment sections 214 at the valve end. The valve abutment sections 214 have a curved profile, as seen in FIG. 6. Outer arm section 200 also includes hydraulic lash adjuster sockets 208 (best seen in FIG. 5).

The rocker arm assembly 10 includes a hydraulic latch-up system for connecting and disconnecting the inner arm portion 100 to and from the outer arm portion 200 near the HLA end. As discussed above, each hole 106 in the inner arm portion 100 can be aligned to a corresponding hole 206 in the outer arm portion 200. Pistons 302 and biasing springs 304 are situated in the space formed by corresponding holes 106 and 206. Hydraulic fluid passages 218 (best seen in FIG. 5) connect HLA sockets 208 to holes 206. In a default position, biasing springs 304 position pistons 302 such that they are located partially in holes 206 and partially in holes 106; thus, locking the inner arm section 100 to the outer arm section 200. In this first state, the inner arm section 100 and outer arm section 200 behave as a unitary structure and cannot rotate relative to one another. In a second state, hydraulic fluid supplied via pass-through HLAs 40 (one shown in FIG. 4) produces pressure against pistons 302 compressing springs 304 such that pistons 302 are located entirely within holes 106. In this second state, the inner arm section 100 is free to pivot relative to the outer arm section 200 about shaft 500. Rotation of the inner arm section 100 relative to the outer arm section 200 results in either compression or extension of lost motion spring 400.

Figure 4:
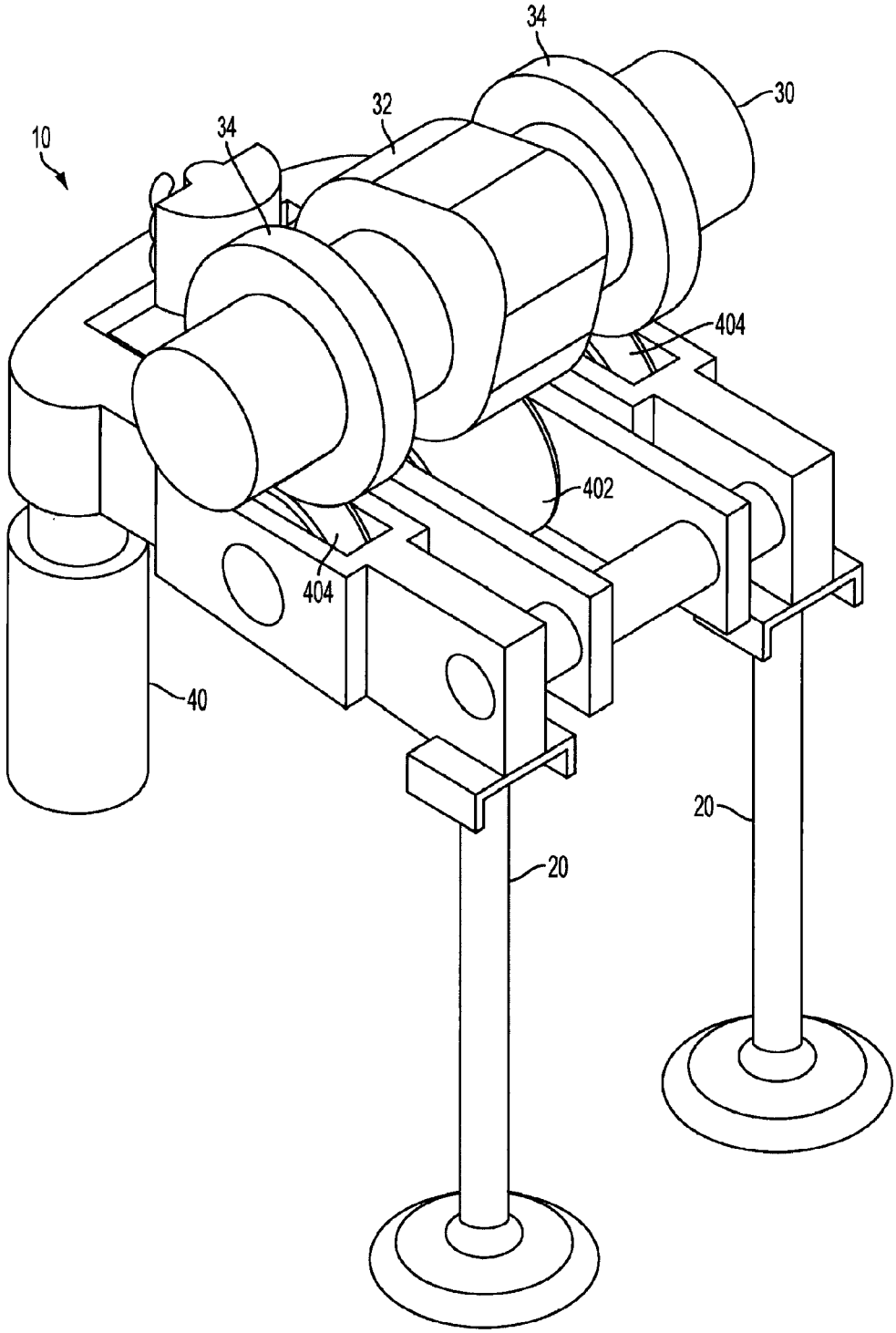
FIG. 4 is a perspective view of a rocker arm assembly in accordance with the present disclosure including additional engine components.
Figure 5:
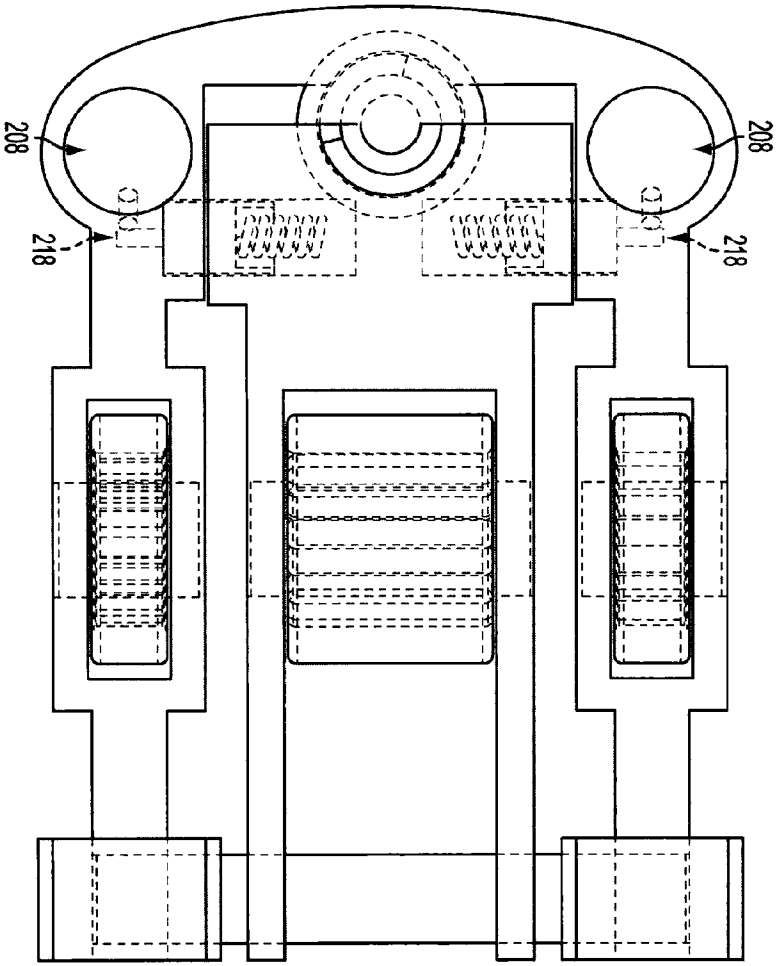
FIG. 5 is a bottom view of a rocker arm assembly in accordance with the present disclosure.

As seen in FIG. 4 when installed in an engine the rocker arm assembly 10 is situated below a cam shaft 30. The cam shaft 30 has lobes 32 (one of which is shown in FIG. 4) that contact inner arm bearing 402. The cam shaft 30 also includes base circles 34 that ride on outer arm bearings 404. The bearings 402, 404 provide rolling contact between the cam shaft 30 components and the rocker arm 10. Valve abutment sections 214 interact with two valves 20 and hydraulic lash adjuster sockets 208 (best seen in FIG. 5) each engage a hydraulic lash adjuster 40 (one shown in FIG. 4).

The operation of the rocker arm assembly 10 is now discussed. In a first state, biasing springs 304 bias pistons 302 such that they are located partially in holes 206 and partially in holes 106, effectively locking the inner arm portion 100 to the outer arm portion 200 near the HLA end. In this first state, the inner arm portion 100 cannot rotate relative to the outer arm portion 200 and the rocker arm assembly 10 acts as a unitary structure. In this first state, the rocker arm assembly 10 provides regular valve lift similar to a conventional rocker arm. When the elongated portion of cam lobe 32 contacts inner arm bearing 402, the rocker arm assembly 10 is rotated and valves 20 are forced open. During the valve lift event, base circles 34, which generally interact with outer arm bearings 404, lose contact with the outer arm bearings 404. As the elongated portion of cam lobe 32 rotates past inner arm bearing 402, valve springs (not shown) close the valves 20 and rotate the rocker arm assembly 10. As the rocker arm assembly 10 is rotated back into the closed valve position, base circles 34 regain contact with outer arm bearings 404.

In order to deactivate a cylinder or to provide alternative valve lift, hydraulic pressure is provided via pass-through HLAs 40 to hydraulic fluid passages 218. This exerts a force on pistons 302, compressing biasing springs 304. Sufficient pressure is applied to move pistons 302 such that they are located entirely within holes 106. In this second state, inner arm portion 100 is able to rotate relative to outer arm portion 200. In the second state, as the elongated portion of cam lobe 32 rotates past inner arm bearing 402 the valves 20 are not opened. Rather, inner arm portion 100 is rotated relative to outer arm portion 200 about shaft 500 compressing lost motion spring 400. As the elongated portion of cam lobe 32 rotates past inner arm bearing 402, inner arm portion 100 is rotated back to its original position by lost motion spring 400. To achieve such relative rotation, lost motion spring 400 has a lower spring constant than the combined spring constant of the valve springs (not shown) associated with valves 20. Unlike the first state discussed above, when the cylinder is deactivated, base circles 34 stay in contact with outer arm bearing 404 throughout the entire cam rotation.

Although cylinder deactivation is described above, it is also possible to achieve reduced valve lift with the disclosed rocker arm assembly 10. In order to produce a reduced valve lift, as opposed to full cylinder deactivation, base circles 34 are replaced with reduced lift lobes (not shown). Similar to base circles 34, the reduced lift lobes ride on outer arm bearings 404. In the second state, as discussed above, the elongated portion of cam lobe 32 causes the inner arm portion 100 to rotate relative to the outer arm portion 200 compressing lost motion spring 400. During reduced valve lift, rather than staying stationary due to base circles 34, outer arm portion 200 is rotated due to the interaction between the reduced lift lobes and outer arm bearings 404 thus opening valves 20. Lost motion spring 400 and the valve springs (not shown) act together as the elongated portion of the cam lobe 32 and the reduced lift lobes rotate past the inner and outer arm bearing 402, 404 to rotate the inner and outer rocker arm portions 100, 200 back into their closed valve position.

Disengaging inner arm portion 100 from outer arm portion 200, by applying hydraulic pressure to pistons 302 as discussed above, effectively allows outer arm portion 200 to operate independently of inner arm portion 100. This negates any valve event normally caused by cam lobes 32 and allows for either full cylinder deactivation by use of base circles 34 or reduced valve lift by including reduced lift lobes in place of base circles 34.

Various techniques are available to control the transition between traditional valve lift and cylinder deactivation or reduced valve lift. Generally the transition will be automatically actuated by the engine control unit based on current operating conditions. It is also possible to change valve lift states based on direct input, such as a push button or switch, from a vehicle operator.

What is claimed is:

1. A rocker arm apparatus, comprising:

first and second outer arms connected to move together, the first and second outer arms having respective first and second recesses formed therein, each recess having a closed end and an open end facing inwardly of the outer arms;

an inner arm located between the first and second outer arms, the inner arm having third and fourth recesses formed therein each having an open end facing outwardly of the inner arm, the inner arm being rotatable relative to the first and second outer arms between first and second positions, the open ends of the first and third recesses facing and being aligned with each other, and the open ends of the second and fourth recesses facing and being aligned with each other when the inner arm is in the first position;

first and second pistons located at least partially in the third and fourth recesses, respectively;

springs urging the first and second pistons outwardly towards the open ends of the third and fourth recesses, respectively, such that when the inner arm is in the first position the first and second pistons extend into the first and second recesses, respectively, thereby locking the inner arm against rotation relative to the first and second outer arms; and first and second fluid flow paths formed in the first and second outer arms, respectively, to allow fluid under pressure to be applied to the first and second recesses, respectively, wherein when the first and second pistons extend into the first and second recesses, they are pushed out of the first and second recesses, by the fluid pressure and the inner arm can be rotated relative to the first and second outer arms.

2. The rocker arm apparatus of claim 1, further comprising a first bearing attached to the inner arm to provide rolling contact with a lobe of a cam shaft.

3. The rocker arm apparatus of claim 2, further comprising a second bearing attached to the first outer arm and a third bearing attached to the second outer arm.

4. The rocker arm apparatus of claim 1, further comprising at least one valve abutment element located at the valve end of each of the first and second outer arms, each valve abutment having a curved surface for contacting an end of a valve stem.

5. The rocker arm apparatus of claim 1, further comprising a lost motion spring coupled between the inner arm and the first and second outer arms.

6. The rocker arm apparatus of claim 5, wherein the lost motion spring resists rotation of the inner arm out of the first position.

7. The rocker arm apparatus of claim 1, further comprising a curved surface on an outer portion of the first outer arm for contacting an end of a valve stem.

8. The rocker arm apparatus of claim 1, wherein the first and second outer arms are fixedly connected by a transverse arm to form a generally u-shaped structure.

9. The rocker arm apparatus of claim 8, wherein the transverse arm is coupled to respective ends of the first and second outer arms.

10. The rocker arm apparatus of claim 9, wherein the first and second outer arms and the transverse arm are integrally formed with one another.

* * * * *